US005200740A

United States Patent [19]

Paxton et al.

[11] Patent Number: 5,200,740

[45] Date of Patent: Apr. 6, 1993

[54] DROPOUT-FREE CENTER POINT FILL METHOD FOR DISPLAYING CHARACTERS

[75] Inventors: William H. Paxton, Los Altos Hills; Stephen N. Schiller, Menlo Park, both of Calif.

[73] Assignee: Adobe Systems Incorporated, Mountain View, Calif.

[21] Appl. No.: 388,336

[22] Filed: Aug. 1, 1989

[51] Int. Cl.[5] ..... G09G 1/06

[52] U.S. Cl. ..... 340/735

[58] Field of Search ..... 340/731, 735, 728; 382/47, 54, 46

[56] References Cited

U.S. PATENT DOCUMENTS

| | | | |
|---|---|---|---|
| 4,447,882 | 5/1984 | Walz | 340/735 X |
| 4,555,191 | 11/1985 | Gojo | 340/735 X |
| 4,712,102 | 12/1987 | Troupes et al. | 340/735 X |

OTHER PUBLICATIONS

Bruce Mielke, "Integrated Computer Graphics," West Publishing Company, New York, 1991, pp. 56–64.

L. E. Tannas, "Flat-Panel Displays and CRTs", Van Nostrand Reinhold Co. Inc., N.Y., pp. 7–9, 1985.

Montanari, Ugo, Continuous Skeletons From Digitized Images, Journal of the Assoc. for Computing Machinery, vol. 16, No. 4, Oct. '69.

*Primary Examiner*—Ulysses Weldon

*Attorney, Agent, or Firm*—Roger S. Borovoy; David J. Larwood

[57] ABSTRACT

Method for displaying characters with improved legibility at relatively low resolution by modifying the center point fill method and displaying additional pixels as needed to maintain connectivity and avoid dropout problems. Additional pixels are turned on as needed where a black section of the character crosses the midline between two adjacent horizontal or vertical pixel centers. If the intersections of a black section of a character with a midline is entirely within one pixel which is not otherwise turned on, then that pixel is turned on; if a black section of a character crosses between two such adjacent pixel reference points in parts of both pixels, and if neither pixel is already on, the pixel having more of the black section, measured along the line between pixel centers, (or other reference points), is turned on.

7 Claims, 5 Drawing Sheets or

DROPOUT-FREE CENTER POINT FILL METHOD FOR DISPLAYING CHARACTERS

FIELD OF THE INVENTION

In modern computer systems, it is often desireable to print or display characters in various sizes on paper, film or a computer screen. When the size of the character is large relative to the resolution of the display or print device, it is relatively easy to choose which picture elements or pixels should be printed or displayed in order to make a readable character. However, when the size of the character is small in relation to the resolution of the display, it is much more difficult to choose which pixels to display in order to make the character as distinct and recognizable as possible. The current invention relates to an improved method of legibly displaying characters at low resolution.

BACKGROUND OF THE INVENTION

Traditionally, characters have been printed using metal type which allows very detailed rendering of a character, including subtle curves and very fine lines. In modern computer devices, characters are defined on raster devices such as video display terminals or by using a multi-pin print head. Characters can be printed on a surface or displayed on a video screen as a series of dots which are printed or turned on in order to approximate as closely as possible the ideal shape of the character. When characters are small enough relative to the resolution of the display device, choosing which pixels should be displayed to accurately represent the character becomes more complex than when the character is large. A typical video monitor can display about 72 pixels per inch. At this resolution it is difficult to display legibly most type faces smaller than about twenty pixels tall.

An ideal representation of the character is usually defined in "character space" at very high resolution as one or more areas bounded by an outline or path. A character consists of one or more continuous black areas. For instance the letter "O" consists of a single closed loop, the letter "d" consists of a loop connected to a line and the letter "i" consists essentially of a dot a short distance away from a line which may have additional details such as serifs. One way of describing a character involves defining an outline of the outer edge of each contiguous black portion of the character and then filling that outline to display the character. Since characters are usually printed in dark ink on a light background, one can describe filled areas as black but one skilled in the art will recognize that characters which are light on a dark background, commonly used in video displays, are also within the teachings of this invention. This path can be represented as a sequential series of curves and/or linear line segments called edges. If a black area has interior white spaces as, for instance, in the letter "O38, each interior white area can also be defined by a path consisting of a series of edges.

When tracing or displaying such a character, it is generally useful to trace the edges in a consistent direction, either clockwise or counter-clockwise. If edges of an outside path are traced in the counter-clockwise direction, then the area to the left of that edge will always be black and the area to the right will always be white. If the path is traced in the clockwise direction, the black area will be on the right of the edge. Enclosed white areas should be traced in the direction opposite to the exterior path so that the black area is on the same relative side of the edge.

When a character is displayed on a raster device, those pixels which fall within the black area of the character should be displayed, that is, they should be printed on a surface or turned on for a video display. At high resolution or when the character is very large, multiple pixels may fall within each black area and the character can be displayed in great detail. When the character is reduced to a small size, however, or the resolution of the device is limited, certain black areas may no longer cover multiple pixels and in fact may cover only a fraction of a pixel. Displaying small characters on a device of limited resolution has been a persistent problem in the past. This is illustrated in the figures by a character on an $8 \times 10$ matrix. In FIG. 1 the outline of the character "S" is illustrated as filled at very high resolution. The raster display, however can only turn on or off entire pixels.

One prior approach to this problem is the center point fill method, illustrated in FIG. 2. A pixel is displayed only if the center of that pixel falls within or on the boundaries of a black area, illustrated by pixels 40–44. Where only a limited number of pixels are available to display the character, there are gaps or dropouts 50–52 in the black areas so that it may be difficult to recognize the character. An alternative way of displaying the character, called area fill, is to turn on all pixels which intersect or fall within the outline of the character. The result, shown in FIG. 3, is that too many pixels are turned on, leading to blobs which also make the character difficult to recognize. At higher resolution both of these methods work successfully but at low resolution characters become difficult to recognize.

SUMMARY OF THE INVENTION

Characters can be displayed with improved legibility at relatively low resolution by modifying the center point fill method and displaying additional pixels as needed to maintain connectivity and avoid dropout problems. Additional pixels are turned on as needed where a black section of the character crosses the line between two adjacent horizontal or vertical pixel centers. Such lines will be referred to as midlines. One could also practice the present invention using reference points or regions within the pixel other than the center. If the intersection of a black section of a character with a midline is entirely within one pixel which is not otherwise turned on then that pixel is turned on. If a black section of a character crosses between two such adjacent pixel reference points in parts of both pixels and if neither pixel is already on, the pixel having more of the black section, measured along the line between pixel centers, is turned on.

One object of this invention is to improve the legibility of characters displayed at low resolution by turning on those pixels in which the center falls in or on the edge of a black area and also turning on enough additional pixels to make the character recognizable. Another object of this invention is to minimize dropout caused by a thin character stem going through a pixel row or column without including a pixel center.

Another object of this invention is to properly display a pointed character feature such as the bottom of a "V." This is important for cases like the base of a "V", where the bottom pixel must be turned on or the character will appear to float off the baseline.

DETAILED DESCRIPTION OF THE INVENTION

A character can be represented by a series of filled areas which contrast with the background. For convenience, the filled areas will be referred to as black areas, as in ink printed on a page, but the filled area can also be light on a dark background, as in a typical video display. Pixels to be displayed can be considered as turned on versus turned off.

The outline of each black area can be defined by a closed path consisting of sequential series of curves or linear line segments called edges. The interior of each black arm can be distinguished from the background by traversing the outline of the character in a clockwise or counter-clockwise direction and filling or turning on of those pixels which are part of the black area. In the following description the outline of the character is assumed to be oriented in the counter-clockwise direction; the left side of each edge is part of the character and the right side of the edge is background. As described above, characters which have enclosed white spaces such as the character "0" will have at least one additional path consisting of a series of edges to define each enclosed space. An interior path should be traversed in the direction opposite to the outer path. A character may contain more than one black area such as the letter "i" or many oriental characters. Once a path or series of paths is defined for a character, that path can, for example, be stored in computer memory and can be used for generating characters of arbitrary size.

Figure 2:
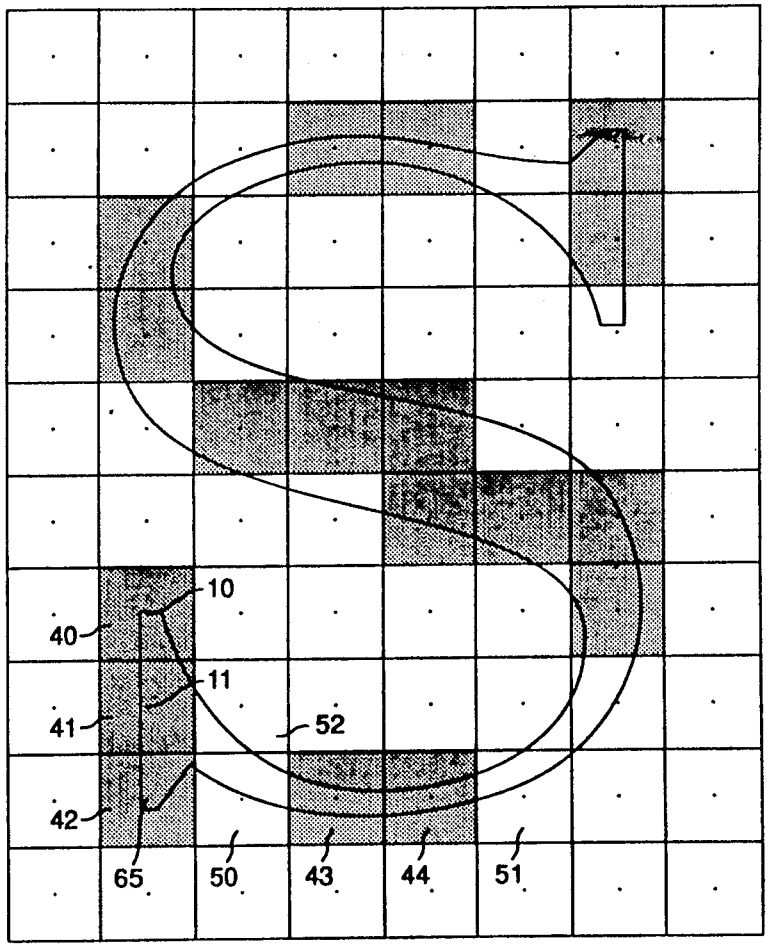
FIG. 2 illustrates the same character outline displayed by low resolution pixels using the center point fill method of the prior art.
Figure 1:
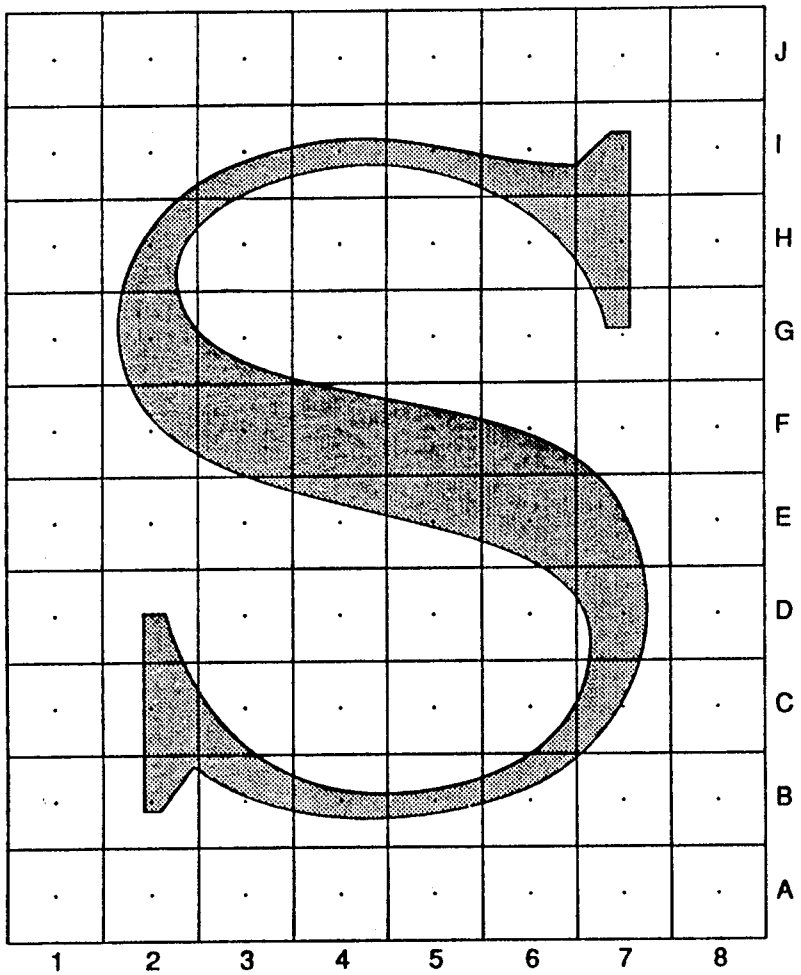
FIG. 1 illustrates the superimposition of the outline of a character displayed at very high resolution on a low resolution pixel matrix.

To display a character in a defined pixel area, often referred to as display space, the outline of the character must first be scaled and placed within a pixel grid by methods well known to those skilled in the art. According to well-known methods generally known as "center-point-fill", pixels 40, 41, 42, having centers 10, 11 and 65 respectively, which fall on or within the outline of the character are selected and displayed. See FIG. 2. When the resolution of the display device is low enough relative to character size, certain portions of the character will not include pixel centers and therefore will no longer be displayed, so the legibility of the character will decrease. In FIG. 2, for example, certain areas 40–44 of the character "S" are properly displayed but pixels such as 50–52 contain areas of the character which do not happen to include a pixel center and thus are not displayed, making the character less legible.

Figure 4:
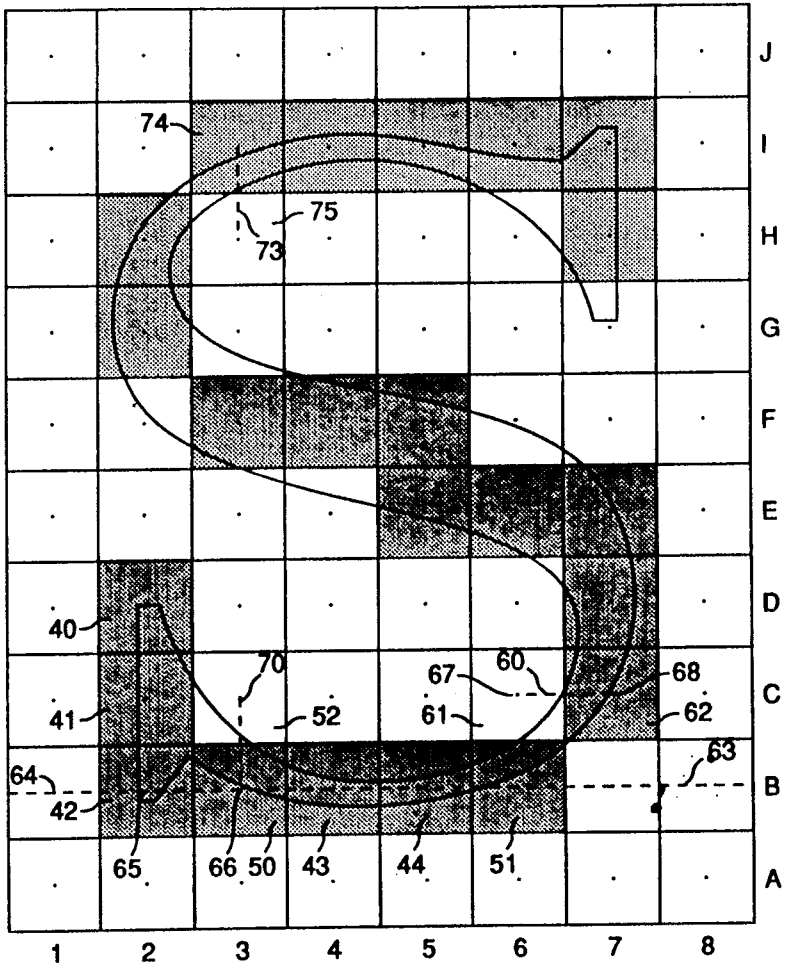
FIG. 4 illustrates the same character outline on the same pixel matrix displayed using the method of the present invention.
Figure 3:
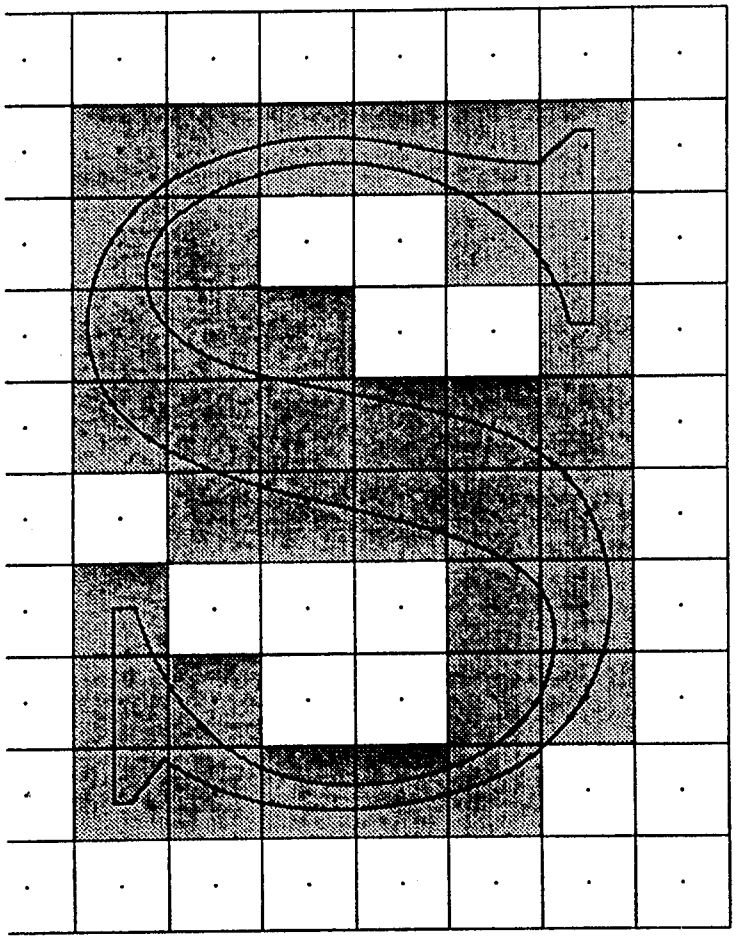
FIG. 3 illustrates the same character on the same pixel matrix displayed using the area fill method of the prior art.
Figure 5A:
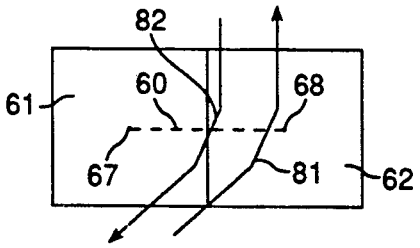
FIGS. 5A and 5B illustrate details of the present invention.
Figure 5B:
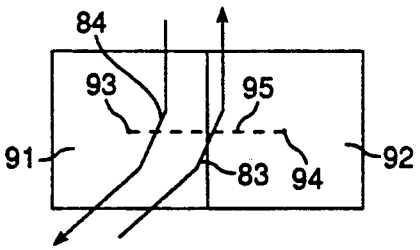

One method of practicing the present invention is illustrated in FIG. 4. The pixels were tested sequentially, starting for example with the pixels in row A numbered 1, 2, 3, etc. in order, followed by pixels in row B starting with number 1 followed by the pixels in row C starting with number 1, and so forth. Pixels were processed by carrying out the following steps for each row.

Where the center point of a pixel such as pixels 42, 43 or 44 fell within a black area of a character, that pixel was turned on. Within each horizontal pixel row, points were identified where edges crossed the horizontal midline such as 63 through the pixel centers, including 64, 65 and 66. Where two consecutive edge crossings occurred between two adjacent pixel centers such as 67 and 68 such that a black section crossed a midline, e.g. 60, the following proximity test was performed. The same test was used for horizontal or vertical midline/character intersections. Compare the examples of edges intersecting horizontal midlines in pixels 61, 62 and 91, 92 of FIGS. 5A and 5B, with edges intersecting vertical midlines in pixels 50, 52 and 74, 75 of FIG. 4. If the black section intersected a midline entirely within one pixel, such as pixel 62 in FIG. 5A or pixel 74 in FIG. 4, that pixel was turned on. If the black section crossed a midline, e.g. 95 in FIG. 5B, in parts of two adjacent pixels, e.g. 91 and 92, and neither pixel was already on, the pixel which contained the greatest length of black section along the midline was turned on. One simple way to select that pixel was to determine the pixel whose center was closer to an edge/midline intersection, e.g. pixel 91 in FIG. 5B and pixel 50 in FIG. 4. If the black section crossed the midline equidistant from both pixel centers and neither pixel was on, one pixel was turned on arbitrarily. One method of resolving the arbitration is to always turn on the first of the two pixels along the scan line. Another method of resolving the arbitration is to alternatively turn on the first and then the second pixel each time an arbitration is required. Other arbitration schemes are well known to those skilled in the art.

Another way to select pixels which include black sections that cross vertical midlines is as follows. Where edges crossed a vertical midline of a pixel not already on anywhere in the row, a pair of flags was set for each such crossing indicating whether the crossing was in the top or the bottom of the pixel and whether the edge was oriented left to right or right to left as it crossed that vertical midline. Multiple pairs of flags were set as needed for each such crossing. After the row was scanned according to the method in the previous paragraph and flags were set, the flags were checked for each pixel in that row which was not already on. If a pixel had only a top, left-to-right or one top, left-to-right plus a bottom, right-to-left crossing, the flags were stored until the next scan line was analyzed to decide whether or not to turn that pixel on. If a pixel had only a bottom, right-to-left or one bottom, right-to-left plus a top left-to-right crossing and the pixel below was already on, then the present pixel was left off, but if the pixel below was off and had flags set indicating only a top left-to-right crossing or one top left-to-right plus a bottom, right-to-left crossing, then the present pixel or the pixel below was turned on according to the proximity test detailed above. If the current pixel had any other flags or combination of flags set, then it was turned on.

After each row was analyzed according to the foregoing method, the pixel map could be displayed or could be stored for future display. For example, pixel 50 in FIG. 4 had a top left-to-right crossing, so appropriate flags were set. Pixel 52 included a bottom right-to-left crossing but pixel 50 was not turned on according to the center point fill test. Applying the proximity test, the edge/midline intersection in pixel 50 was closer to the pixel center than the edge/midline intersection in pixel 52, so pixel 50 was turned on.

Figure 6A:
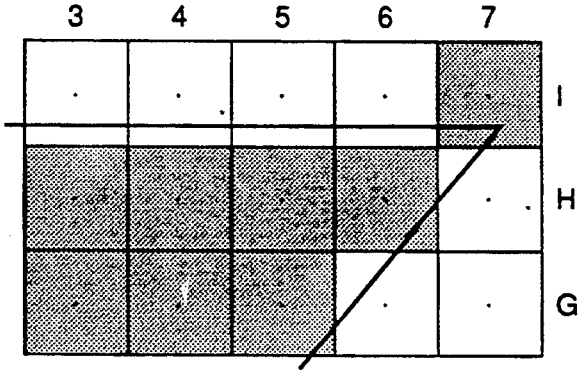
FIGS. 6A–6C illustrate details of displaying corners in FIGS.

The method described above will give generally accurate character bit-maps, but certain shapes will cause an inappropriate pixel to be turned on. This is illustrated in FIG. 6 by a path which could be part of the letter "Z" or the number "7. " Pixels H3–H6 were turned on in accordance with the center-fill test. Pixels 13–16 were not turned on since each had a flag for only a bottom right-to-left crossing and the pixel below was already on. Pixel 17 contained a black section which crossed the vertical midline between pixels I7 and H7 but was entirely within I7, so I7 was turned on. The character would, however, be more legible if I7 was not turned on. Note that the result would be better if the path crossed the I7–H7 midline with one edge in H7 that was farther from the center of H7 than the edge in I7 was from the center of I7.

Figure 6B:
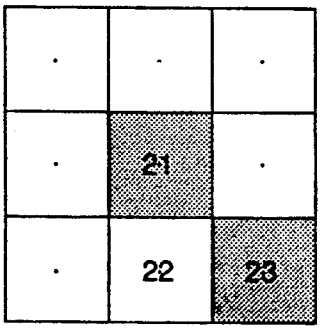
Figure 6C:
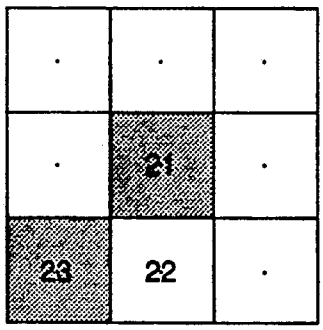

Such artifacts were eliminated by the following procedure. Whenever, during the principle rasterization, a decision was made to activate or not activate a pixel according to the proximity test, the resulting decision was stored as a proximity-pixel pair consisting of the selected pixel and the alternate pixel. The alternate pixel was necessarily horizontally or vertically adjacent to the selected pixel. After the entire bit-map had been scanned, each proximity-pixel pair was examined for the following pattern, two examples of which are illustrated in FIG. 6B and 6C. Starting from the selected proximity pixel, if a corner pixel adjacent to the alternate pixel and immediately diagonal to the selected pixel was on, if the three pixels horizontally and vertically adjacent to the selected pixel (other than the alternate pixel) were either off or outside the pixel grid and the three pixels diagonally adjacent to the selected pixel (other than the corner pixel) were either off or outside the pixel grid, then the selected pixel was determined to be incorrectly chosen. In this case, the selected pixel was turned off and the alternate pixel was turned on.

Figure 7:
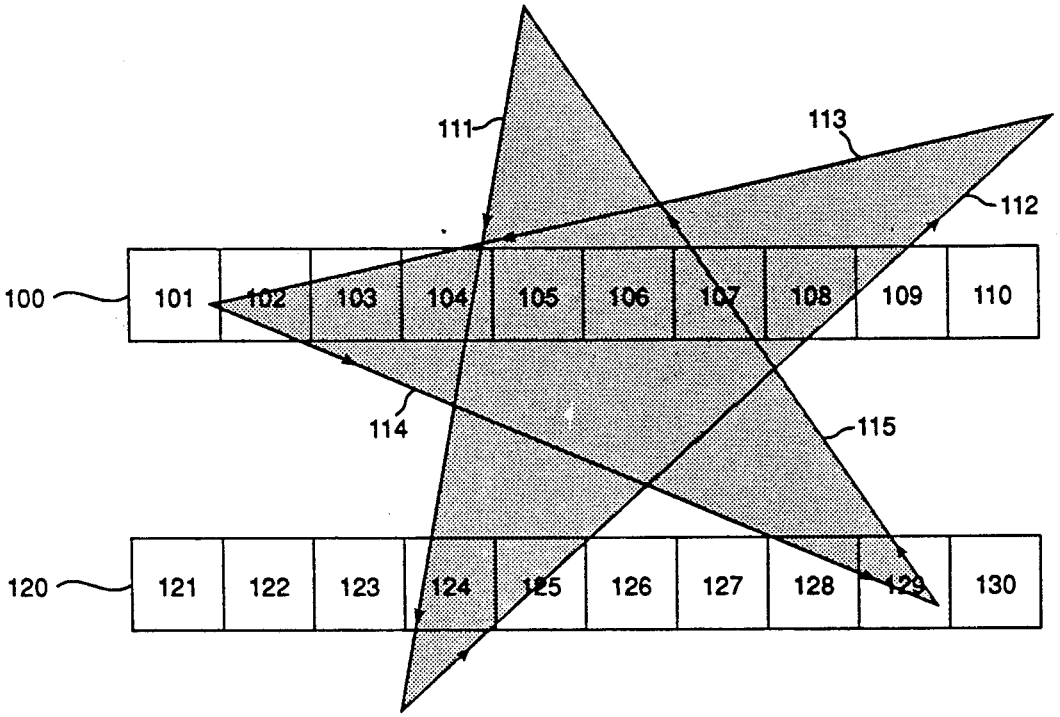
FIG. 7 illustrates a figure with multiple edges and enclosed black and white spaces.

It is possible to describe or outline some characters with a path which crosses itself one or more times. The five pointed star shown in FIG. 7 is one such example. If a row of pixels such as Row 100 is scanned from 101–110, pixels intersect the five edges 111–115 of the five pointed star. According to the method described above, pixels 103 and 104 are between edges 113, 114 and 111 and therefore should be displayed. Pixel 108 is between edges 112, 113 and 115 and should also be displayed. Pixels 105, 106 and 107 should also be displayed because they are to the left of edges 111 and 115. Pixels 126, 127 and 128, however, are also between edges 111 and 115 but should not be displayed.

Two well known methods of displaying complex figures such as this are the even-odd method or the winding number method. To best illustrate the invention, the following discussion will illustrate its use with the winding number method using that method where an edge crosses a horizontal or vertical reference line, the direction of the path should be stored. According to the winding number method, for each crossing of a certain direction, for instance, downward, a winding counter can be incremented and for each crossing in the opposite direction, up in this example, the winding counter is decremented. In scanning line 100, where edge 113 crosses pixel 102 the winding counter is increased by 1, where edge 111 crosses pixel 104 the winding counter is increased again, where edge 115 crosses pixel 107 the winding counter is decreased by 1 and where edge 112 crosses pixel 109, the winding counter is again decreased. For every pixel between edges where the winding number is non-zero, that pixel should be displayed. Row 120 gives an example where the winding number increases to 1 in pixel 124 and decreases to zero in pixel 125, increases again to 1 in pixel 129 and decreases to zero in that same pixel. Since the winding number is zero for pixels 126, 127 and 128, those pixels are left off. This sort of situation occurs in many characters, for example the letter "B."

One skilled in the art will recognize that the method of this invention can be practiced by scanning the pixel rows vertically rather than horizontally and making appropriate modifications in the method. One skilled in the art can also practice a variation of the method of this invention wherein horizontal rows of pixels are scanned to determine where edges cross the horizontal midline of the row, turning on those pixels having centers included in the interval between two consecutive edge crossings such that those centers are either on an edge or within a black section of the character and also turning on those pixels having a black section between two horizontal pixel centers according to the proximity test. Each column of pixels should then be scanned, to determine where edges cross the vertical midline of the column, turning on those pixels having centers included in the interval between two consecutive edge crossings such that those centers are either on an edge or within a black section of the character and also turning on those pixels having a black section between two vertical pixel centers according to the proximity test.

Another variation that can be practiced by those skilled in the art is to first do a normal center point fill, and then stroke the skeleton of the character using a line drawing algorithm. One method of deriving a character skeleton is described by *U. Montanari*, "Continuous Skeletons from Digitized Images," *Journal of the Association for Computing Machinery*, 16(4): 534–549, Oct. 1969. Once the skeleton is determined, wherever the skeleton passes through a horizontal or vertical midline of a pixel which is not already on, according to the center point fill algorithm, the pixel should be turned on.

Another variation of this invention is useful when the computer program is not required to run quickly and it is desired to choose the best possible pixel arrangement to represent the character. This detail-oriented version of the algorithm described above was divided into two parts that roughly corresponded to the two parts of the previously mentioned algorithm: a) while determining certain character attributes doing a normal center point fill, and b) turning on extra pixels to avoid dropout.

The first part of this detail-oriented method included examining various properties of each pixel beyond just whether or not its center was within the outline to determine if it should be turned on or not. These properties included: 1) the area of the pixel inside the outline, 2) whether any part of the outline passing through the pixel realized local maxima or local minima in either the X or Y coordinates, 3) whether any part of the outline passing through the pixel had any sharp corners and 4) whether the pixel was known to lie on the base line, capital height line or X-height line for characters of the font being considered. All of the above quantities were given numeric values which were then considered independently. If any of these quantities exceeded a certain threshold the pixel was turned on. For example, if part of character was within a pixel but did not include the pixel center, if the occupied area was greater than approximately 60%, that pixel was turned on. If any part of the character outline realized a local vertical minimum in the lower half of a pixel or a local vertical maximum in the upper half of the pixel, that pixel was turned on. Horizontal maxima and minima were treated similarly. If an outline passing through a pixel had any sharp corners, that is the outline formed an angle sharper than 90 degress, then a line bisecting that angle was drawn to the closest pixel edge. A sharpness factor was calculated thus: 90 degrees minus the actual angle times a constant (approximately 1/100). If the sum of the sharpness factor and the length of the bisecting line was greater than one-half a pixel edge length, that pixel was turned on. Finally, if a pixel was known to lie on the base line, capital height line or x-height line, each of the preceding three factors were treated as more significant, that is, if the pixel was one one of these lines and if the included area was approximately 50% or more, if a local minimum was below only about 0.55 pixel units or if the corner parameter was less about 0.45, then the pixel was turned on.

The purposes of the four criteria listed above are: 1) to turn on pixels that are mostly covered by the outline even though their centers may not be covered, 2) to make sure that curved parts of the character reach a predictable size in their horizontal and vertical directions and will thereby be consistent with other characters with similar shapes, 3) to insure that if the outline has sharp corners, which often are part of character features important for recognition of that character, that pixels will be turned on to represent these corners, and 4) to be sure that the various characters of a font all share the same base line, capital height and X-height.

Figure 8:
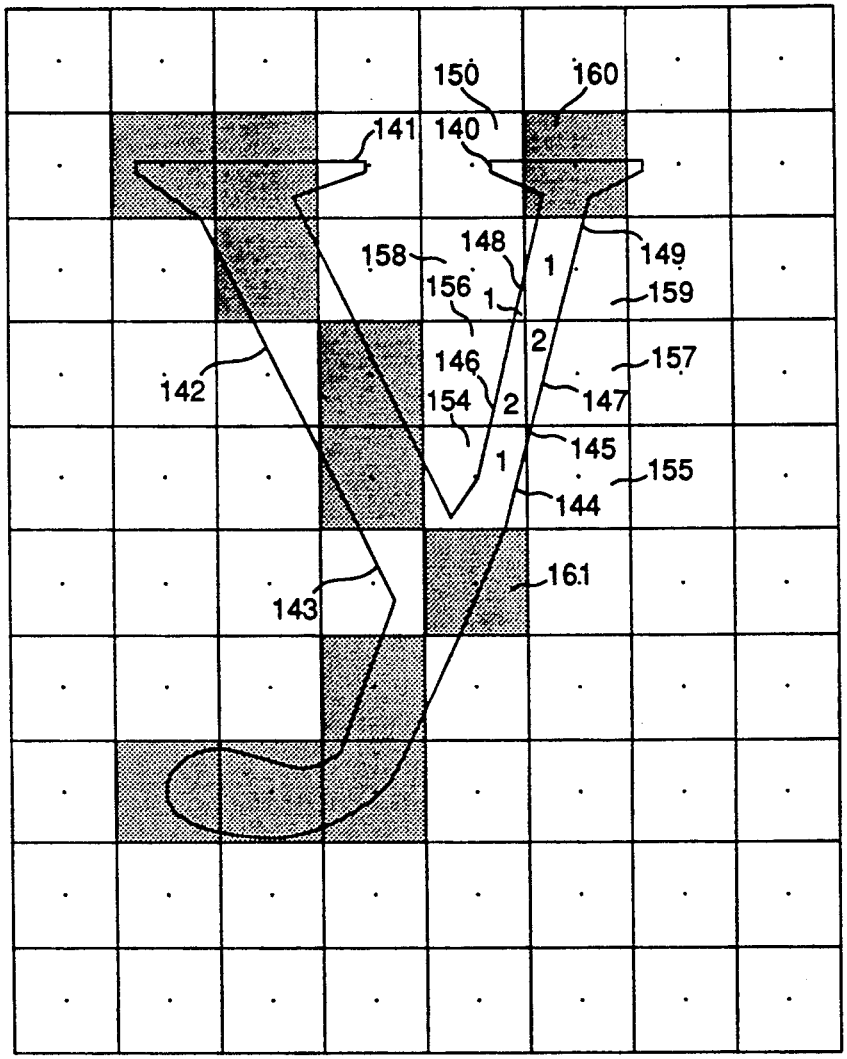
FIG. 8 illustrates the detail-oriented method of correcting dropout.

Dropout problems may still remain after doing the first part of the detail-oriented method, as with the center point fill method of the prior art. The second part of this algorithm corrected the dropout problems by considering all parts of the original character shape that were not in the bit map as created at this stage. This process is illustrated in FIG. 8. The various parts such as 140–149 of the original continuous character shape not within a displayed pixel were identified, and divided by the pixel grid into pixel sub-pieces. For each sub-piece, S, a distance number was computed telling the minimum number of other pixel sub-pieces that must be traversed to get to a pixel that has been turned on, including the pixel sub-piece itself. In this example, adjacent is used to mean two pixels intersect on an edge or a corner. For example, pixel sub-piece 144 is adjacent to a displayed pixel that should be connected to discontinuous pixel 160 so its distance number is one, but sub-pieces 146 and 147 are one pixel removed from displayed pixels 160 or 161 so their distance number is two. Pixels containing sub-pieces are then turned on as necessary to make the FIG. continuous.

If displayed portions A & B of the character should have been connected but intervening pixels were not displayed, a list of pixels giving the shortest connecting path of sub-piece pixels was determined by the following method. Among the pixel sub-pieces touching group A, the sub-piece with the largest area was selected. The corresponding pixel necessarily had a distance number of 1, relative to A. Starting from the selected pixel sub-piece, each adjacent pixel sub-piece having a distance number greater by one was tested and the pixel containing the largest such sub-piece was selected. This process was repeated until the adjacent pixels had only decreasing distance numbers. At that point, the criteria for selection of the next pixel sub-piece was modified by requiring that the distance number of the next pixel in the list went down by one instead of up. Pixels already in the list were not considered. The list was complete when a pixel was added that touched the second group, B. Once the list was completed, the pixel containing each piece in the list was turned on. For example, pixels 161 and 160 should have been connected but were not connected by the first part of the method. Starting from pixel 160, pixels 158 and 159 were adjacent to pixel 160 but pixel 159 included a larger sub-piece 149. Therefore, 159 was the first pixel on the list. Continuing from 159, 156 and 157 each had a distance number of 2 but 156 included the greater amount of character sub-piece area, so pixel 156 was added to the list. There were no sub-pieces adjacent to 156 that had a distance number greater than 2 and 157 was already in the list, so it was ignored. Continuing from pixel 156, 155 and 154 each contained a portion of the character having the next lower distance number, 1. Pixel 154 was selected because it included the greater character sub-piece area. The list comprising 159, 156 and 154 gave a connected path between pixels 160 and 161.

One advantage of this method for correcting dropout is that it gives the minimum number of pixels to connect disconnected groups, while still following the path of the character outline.

The method of this invention has been described generally using pixel centers as reference points. One skilled in the art will recognize that other reference regions can also be used, such as a small circle or diamond around or near the pixel center or even a reference region which does not include the pixel center. One skilled in the art will recognize and be able to practice additional variations on the methods described which fall within the teachings of this invention.

What is claimed is:

1. In a method of displaying a character consisting of one or more contiguous black sections on a raster device using the center point fill method of selecting and displaying pixels by turning on those pixels having centers within said black sections, and selecting and displaying additional pixels to make the character connected, comprising the steps of:

before displaying said character, identifying pixels that partially fall within a black portion of the character but where the center of such pixels do not fall within said black portion, and where such pixels are located between discontinuous portions of the character represented by said pixels turned on by said center point fill method that should be connected but are not, and displaying identified pixels which form a closed path between said discontinuous portions of said character, selecting those pixels containing the greatest amount of black to provide a continuous path through the character at least one pixel wide, thus removing said discontinuous portions of the displayed character.

2. The method of claim 1 wherein the selecting of additional pixels is carried out by first determining a skeleton of the character and then, wherever said skeleton passes through a horizontal or vertical midline of a pixel which is not already on, turning said pixel on.

3. In a method of displaying a character comprised of one or more black areas on a raster device at an arbitrary resolution so as to approximate as closely as possible a high-resolution representation of that character displaying particular pixels by delineating each contiguous black section of that character by an outline consisting of one or more closed paths, said paths consisting of continuous, sequential series of line segments or curves called edges which enclose each black section and then filling the black sections by displaying only those pixels which have reference points that fall on the edge of or within a black section of the character, the improvement consisting of:

defining a reference point or region within each pixel, then displaying those pixels which have reference regions that fall on or within a black section of the character, then displaying those pixels not already displayed where a black section of the character crosses the imaginary reference line between reference regions in two adjacent horizontal or vertical pixels and the intersection of the black section and the reference line falls entirely within that pixel, and if the black section intersects a reference line in parts of two adjacent pixels and neither pixel is already displayed, displaying the pixel containing the greatest length of intersection of the black section and the reference line.

4. The method of claim 3 wherein a pixel is displayed if a black section crosses a reference line with one edge in each of two adjacent pixels and neither pixel is already on, by displaying the pixel in which one edge of the black section crosses the reference line closer to the reference point of that pixel than the other edge of the black section is to the references point of the adjacent horizontal or vertical pixel.

5. The method of claim 3 wherein the reference point is the center of each pixel.

6. The method of claim 5 wherein the reference line is a line connecting adjacent horizontal or vertical pixel centers.

7. The method of claim 3 wherein the reference point is a region which may or may not include the pixel center.

* * * * *

UNITED STATES PATENT AND TRADEMARK OFFICE

CERTIFICATE OF CORRECTION

PATENT NO. : 5,200,740

DATED : April 6, 1993

INVENTOR(S) : Paxton et al.

It is certified that error appears in the above-indentified patent and that said Letters Patent is hereby corrected as shown below:

| | | |
|---|---|---|
| Col. 01, line 59 | delete "O38," | insert --"O",-- |
| Col. 05, line 16 | delete "13-16" | insert --I3-I6-- |
| Col. 05, line 19 | delete "17" | insert --I7-- |
| Col. 10, line 16 | delete "references" | insert --reference-- |

Signed and Sealed this

Twenty-first Day of June, 1994

*Attest:*

Bruce Lehman

BRUCE LEHMAN

*Attesting Officer*

*Commissioner of Patents and Trademarks*